US005588343A

United States Patent [19]

Rust et al.

[11] Patent Number: 5,588,343

[45] Date of Patent: Dec. 31, 1996

[54] HANDLE WITH IMPROVED GRIP ASSEMBLY FOR HAMMERS AND THE LIKE AND METHOD OF MAKING SAME

[75] Inventors: Howell B. Rust, Manchester; Kenneth W. Hreha, Tullahoma, both of Tenn.

[73] Assignee: The Stanley Works, New Britain, Conn.

[21] Appl. No.: 306,835

[22] Filed: Sep. 15, 1994

[51] Int. Cl.[6] ..... B25G 1/01

[52] U.S. Cl. ..... 81/489; 81/20; 81/22

[58] Field of Search ..... 81/489, 177.1, 81/177.8, 22, 20, 492, 451; 30/340, 342; 29/278

[56] References Cited

U.S. PATENT DOCUMENTS

| | | | |
|---|---|---|---|
| 2,757,694 | 8/1956 | Curtis . | |
| 2,781,805 | 2/1957 | Freeman | 81/20 |
| 2,884,816 | 5/1959 | Lay | 81/20 |
| 3,261,909 | 7/1966 | Rust et al. . | |
| 3,302,673 | 2/1967 | Forsberg . | |
| 3,320,985 | 5/1967 | Maguire et al. . | |
| 3,583,010 | 6/1971 | Woodrum | 81/451 |
| 3,779,296 | 12/1973 | Echeverria . | |
| 4,189,202 | 2/1980 | Myking . | |
| 4,558,726 | 12/1985 | Clay | 81/20 |
| 4,683,784 | 4/1987 | Lamont . | |
| 5,031,272 | 7/1991 | Carmien | 81/20 |
| 5,056,381 | 10/1991 | Carmien | 81/20 |
| 5,259,274 | 11/1993 | Hreha . | |
| 5,280,739 | 1/1994 | Liou | 81/22 |

*Primary Examiner*—Willis Little
*Attorney, Agent, or Firm*—Pepe & Hazard

[57] ABSTRACT

A soft-grip handle for hammers and the like has an elongated core member and a synthetic resin sleeve extending along the core member adjacent its tool mounting end. The sleeve has a peripheral collar extending about its end spaced from the tool mounting end, and a grip member of relatively resilient material extends about the core member from its grip end and has an end portion overlying and interlocked with the collar on the sleeve. The core member desirably has a channel therein extending from the grip end and the grip member has a portion disposed within the channel to interlock the core and grip members.

20 Claims, 2 Drawing Sheets

HANDLE WITH IMPROVED GRIP ASSEMBLY FOR HAMMERS AND THE LIKE AND METHOD OF MAKING SAME

The present invention relates to hand tools, and more particularly, to handles with synthetic resin jackets for tools such as hammers.

For many years, various constructions have been utilized to provide synthetic resin and rubber jackets on hand tools utilizing metal cores for the handles. More recently, reinforced synthetic resin rods have been used as cores. Such jackets are desirable to provide insulation for the user in case of accidental contact with current carrying wire. Moreover, they lend themselves to surface characteristics which facilitate secured gripping and, by proper choice of materials, providing some reduction in the impact forces which would otherwise be transferred to the user's hand and arm.

Illustrative of such composite structures in tools are Curtis U.S. Pat. No. 2,757,694, McGuire et al U.S. Pat. No. 3,320,985, and Echeverria U.S. Pat. No. 3,779,296. Composite structures utilizing fiber reinforced plastics have been employed such as shown and described in Hreha U.S. Pat. No. 5,259,274. In some of the structures utilizing composite cores such as that illustrated in the Hreha Patent, a sleeve has been molded about the tool mounting end, utilizing therefor a resin which is relatively rigid and impact resistant. A resin of softer or more resilient character is then molded about the remainder of the core to provide a relatively soft grip. Whether metal or plastic has been employed for the core member, there has been a problem with respect to ensuring adequate retention of the grip upon the core and preventing both relative rotation forces which would tend to shear an adhesive bonding the two surfaces together. There has also been a tendency for the grip to pull away from the sleeve as it cools after molding against its end.

It is an object of the present invention to provide a novel jacketed handle for hammers and the like in which the grip is securely coupled to the underlying core and adjacent sleeve.

It is also an object to provide such a handle which can be fabricated relatively easily and relatively economically.

Another object is to provide a simple and efficient method for making such handles.

SUMMARY OF THE INVENTION

It has now been found that the foregoing and related objects may be readily attained in a handle for hammers and the like utilizing an elongated core member having a tool engaging end and a grip end, and a synthetic resin sleeve on the core member adjacent the tool engaging end. The sleeve has a peripheral collar extending about its end disposed towards the grip end, and a grip member of relatively resilient material extends about the core member from the grip end and has an end portion overlying and interlocked with the collar on the sleeve.

Preferably, the core member is fabricated of synthetic resin, and the core member has a channel therein extending from the grip end and over a portion of its length. The grip member has a portion disposed within the channel to interlock the core and grip members.

Desirably, the core member has a cross section providing a major axis and a minor axis. A slot extends across the core member in the major axis from the grip end along a portion of the length of the core member. The grip member has a portion disposed within the slot to interlock the grip and core members.

In the preferred embodiment, the sleeve is fabricated of a relatively rigid synthetic resin and has an intermediate body portion and a peripheral groove between the body portion and the collar. The collar is of lesser dimensions than the dimensions of the body portion, and the overlying portion of grip member has a peripheral surface contour which blends into the peripheral surface contour of the body portion of the sleeve. Most desirably, the grip member extends about the grip end of the core member.

DETAILED DESCRIPTION OF THE PREFERRED EMBODIMENTS

Figures 1, 2:
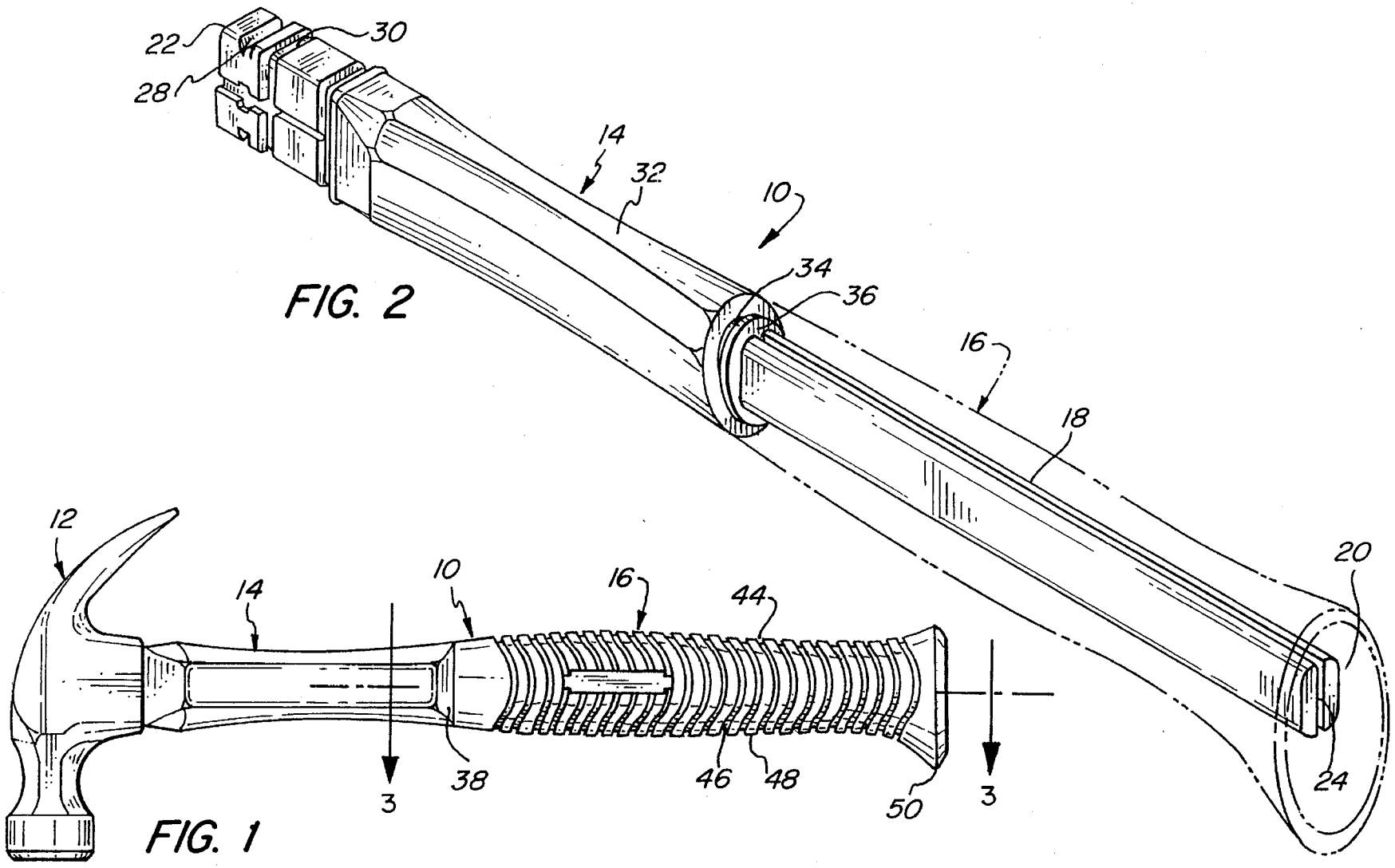
FIG. 1 is a side elevational view of a hammer having a handle embodying the present invention.
FIG. 2 is a perspective view, drawn to an enlarged scale, of the handle of the hammer of FIG. 1 with the resilient grip shown only in phantom line.
Figure 3:
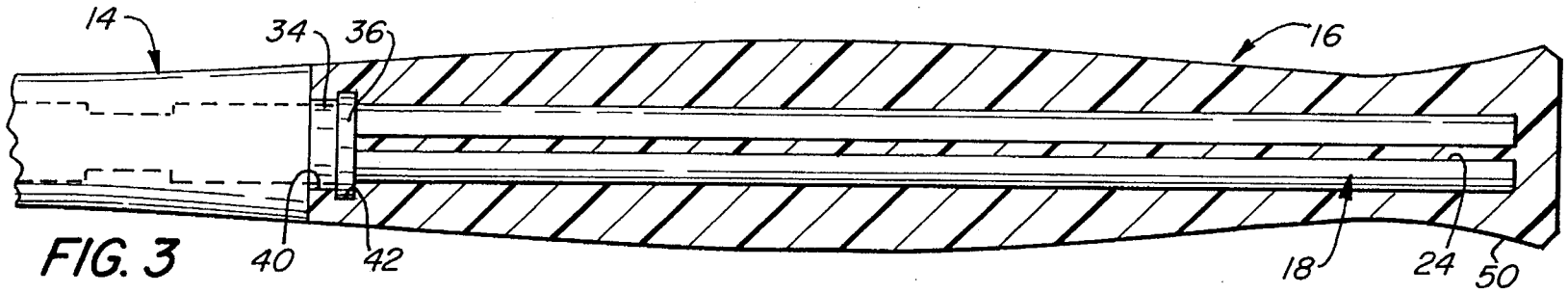
FIG. 3 is a fragmentary sectional view of the handle along the line 3—3 of FIG. 1 in which the ribs and grooves of the grip have been omitted.
Figure 4:
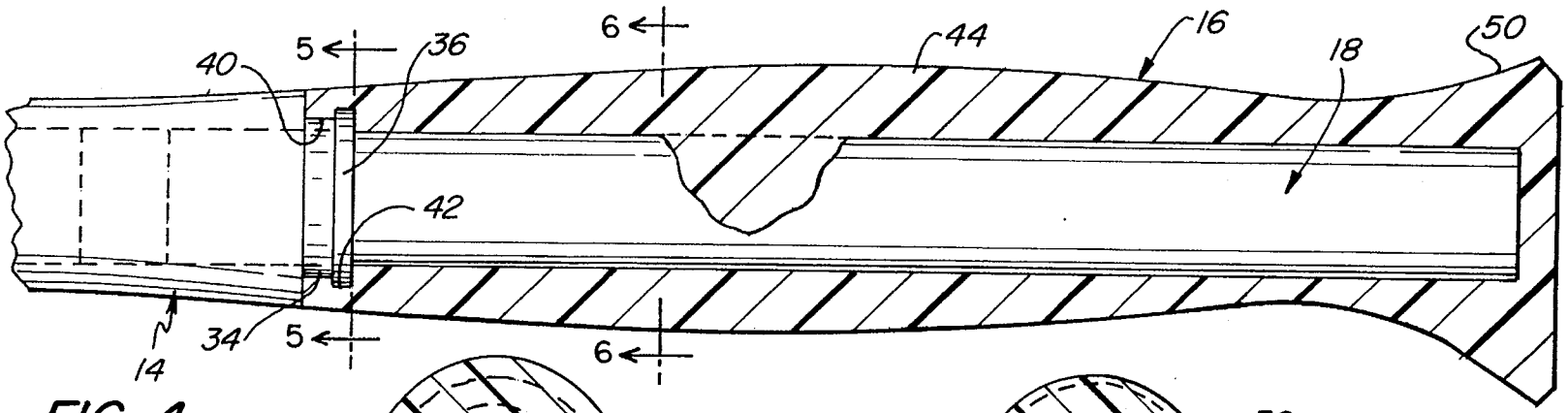
FIG. 4 is a similar fragmentary sectional view of the handle of FIG. 3 but along a section line rotated 90° from that in FIG. 3.
Figure 5:
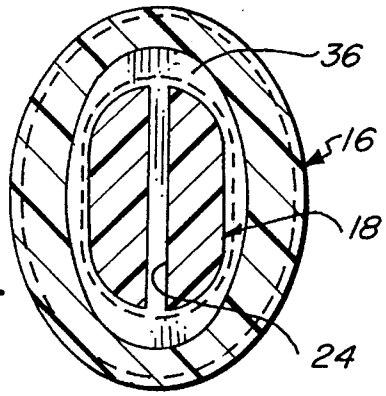
FIG. 5 is a transverse sectional view of the handle along the line 5—5 of FIG. 4.
Figure 6:
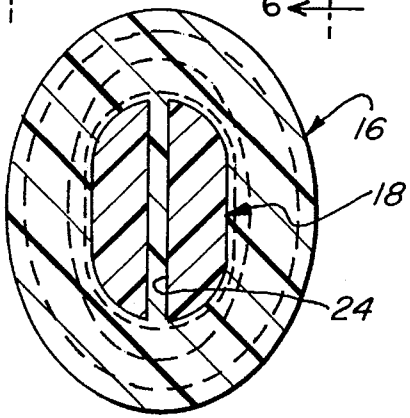
FIG. 6 is a transverse sectional view along the line 6—6 of FIG. 4.

Turning first to FIG. 1, therein illustrated is a hammer employing a handle embodying the present invention generally designated by the numeral 10 which has mounted thereon at one end a conventional claw hammer head generally designated by the numeral 12. The handle 10 includes a sleeve generally designated by the numeral 14 extending along the grip end portion thereof and a resilient grip generally designated by the numeral 16 extending along the length of the handle 10 from the sleeve 14 to the opposite end thereof.

As seen in FIG. 2, the handle 10 has a core generally designated by the numeral 18, a grip end 20 and a tool end 22. In this view, the grip 16 is illustrated in phantom line so as to show the transverse channel or slot 24 extending in the major axis of the core 18 from the grip end 20 to the sleeve 14 and partially underlying the end thereof. The sleeve 14 is molded onto the core 18 and has a complex configuration for the tool end portion 22, including grooves 30 and recesses 28 which enable the secure bonding of the head 12 thereon by adhesive seated in the recesses 28 and grooves 30. The body portion 32 of the sleeve 14 is free from channels and grooves and has a relatively streamlined configuration. At the grip end, the sleeve 14 has a peripheral groove 34 and a terminal collar 36 which is of lesser dimension than the body portion 32.

Turning now to the grip 16, it has an inner end portion 38 which overlies the end of the sleeve 14, and it is configured to provide a peripheral collar 40 which is disposed in the groove 34 of the sleeve 14, and an adjacent peripheral recess 42 which seats the collar 36 on the end of the sleeve 14. This firmly interlocks the two end portions. The outer end portion 50 of the grip 16 flares outwardly from the contoured body portion 44 and, as seen in FIG. 1, the body portion is molded with a series of grooves 46 and ribs 48 to enhance the ability of the hand to grip the surface firmly and concurrently to enhance the resilient nature of the grip surface to improve the comfort in handling. As seen in FIGS. 3–6, the material of the grip 16 extends through the channel or slot 24 in the core 18, thus firmly interlocking the grip 16 with the core 18 and preventing relative rotation. This eliminates the need for any adhesive bonding between the grip 16 and core 18, although adhesives may also be employed if so desired.

For convenience, the grooves 46 and ribs 48 have been omitted in the illustrations of the grip in FIGS. 3–6.

The preferred technique for achieving the interlock between the grip and the core is by providing a transverse slot extending throughout the full length of the grip portion to minimize any tendency for rotation between the grip and the core. However, axial channels in the periphery of the core which do not extend through the core will also provide an interlocking although not so firmly as the transverse slot of the illustrated embodiment. The slot does not extend throughout that length of the core but only through the length of the core upon which is mounted the grip.

The preferred cross section for the core is one which is other than circular and is conveniently of an oval shape as is illustrated in the drawings, and the slot extends in the elongate axis. By utilizing a uniform cross section for the core, it may be pultruded with glass and carbon fiber reinforcement. Various resins may be used for the matrix, but they should exhibit high strength and impact resistance. A suitable composition is an isophthalic styrenated polyester resin reinforced with 77 percent glass and 2.5 percent graphite fibers.

The sleeve may be molded with various external configurations so long as it provides the desired collar at its grip end to interlock with the material of the grip which is molded thereabout. By the combination of mechanically interlocking the sleeve and grip and the grip and core, adhesive bonding may be eliminated.

The illustrated configuration of grooves and recesses at the tool mounting end have been found highly effective in producing a good bond with the metal walls of the eye through the tool which seats the handle. A preferred method and construction for securing the sleeve in the eye of the tool is described and illustrated in greater detail in Hreha U.S. Pat. No. 5,259,274 granted Nov. 9, 1993.

Although various materials may be utilized for molding the sleeve, the resin selected should be one which has good impact resistance and good resistance to fatigue. An impact modified alloy of polycarbonate and polyethylene terephthalate resin sold by Mobay under the designation "Macroblend UT 1018" has been found highly satisfactory.

If so desired, more than one collar and groove pair may be provided at the end of the sleeve for interengagement with the grip which is molded thereabout. However, the single collar and groove of the illustrated embodiment has been found to eliminate any tendency for the grip to pull away from the sleeve.

For the material of the grip, plasticized polyvinyl chloride resins have been found highly satisfactory. However, other materials providing good impact resistance, acceptable resiliency and desirable resistance to grease and oil may be employed.

In molding the handle, one end of the core is initially placed in a mold configured to provide the sleeve, and the sleeve is molded thereabout. Subsequently, the grip end of the core is placed in another mold, and the grip is formed about the core and the end portion of the sleeve. Subsequently, the handle is bonded to a tool by inserting it into the eye of the tool together with the resin which is cured to produce the adhesive and frictional bond therebetween.

Thus, it can be seen from the foregoing detailed description and attached drawings that the handle of the present invention is one which provides secure interengagement between the molded grip and the underlying core and between the molded grip and the adjacent sleeve so that there is no tendency for the grip to pull away from the sleeve or to rotate about the core. This enables the elimination of adhesives to secure the grip to the core and the failures which occur when the adhesive bonding is not sufficient. The handle may be readily manufactured and will exhibit desirable properties therefor including impact resistance, resistance to passage of currents therethrough, and long life.

Having thus described the invention, what is claimed is:

1. A handle for hammers and the like comprising;

(a) an elongated core member having a tool engaging end and a grip end;

(b) a synthetic resin sleeve on and securely interlocked with said core member adjacent said tool engaging end, said sleeve having a peripheral collar extending about its end disposed towards said grip end; and (c) a grip member of relatively resilient material extending about said core member from said grip end and having an end portion overlying and interlocked with said collar on said sleeve, said grip member being securely interlocked with said core member.

2. The handle in accordance with claim 1 wherein said core member is fabricated of synthetic resin.

3. The handle in accordance with claim 1 wherein said core member has a channel therein extending from said grip end and over a portion of its length, said grip member having a portion disposed within said channel to interlock said core and grip members.

4. The handle in accordance with claim 1 wherein said core member has a cross section providing a major axis and a minor axis.

5. The handle in accordance with claim 4 wherein said core member has a slot therein extending across said core member in said major axis, said slot extending from said grip end along a portion of the length of said core member, said grip member having a portion disposed within said channel to interlock said grip and core members.

6. The handle in accordance with claim 1 wherein said sleeve is fabricated of a relatively rigid synthetic resin and has an intermediate body portion and a peripheral groove between said body portion and said collar, said collar being of lesser dimensions than the cross sectional dimensions of said body portion.

7. The handle in accordance with claim 6 wherein said overlying portion of grip member has a peripheral surface contour which blends into the peripheral surface contour of said body portion of said sleeve.

8. The handle in accordance with claim 1 wherein said grip member extends about the grip end of said core member.

9. A handle for hammers and the like comprising;

(a) an elongated core member having a tool engaging end and a grip end, said core member having a channel therein extending from said grip end and over a portion of its length;

(b) a sleeve of relatively rigid synthetic resin on said core member adjacent said tool engaging end, said sleeve having a body portion, a peripheral collar extending about its end disposed towards said grip end, and a groove between said collar and said body portion; and (c) a grip member of relatively resilient material extending about grip end of said core member and from said grip over said collar and groove, said grip member having an end portion interlocked with said collar on said sleeve, said grip member having a portion disposed within said channel of said core member to interlock said core and grip members.

10. The handle in accordance with claim 9 wherein said core member is fabricated of synthetic resin.

11. The handle in accordance with claim 9 wherein said core member has a cross section providing a major axis and a minor axis.

12. The handle in accordance with claim 11 wherein said member channel is a slot extending across said core member in said major axis, said slot extending from said grip end along a portion of the length of said core member.

13. The handle in accordance with claim 9 wherein said collar is of lesser cross sectional dimensions than the dimensions of said body portion, and said overlying portion of grip member has a peripheral surface contour which blends into the peripheral surface contour of said body portion of said sleeve.

14. In a method for making handles for hammers and the like, the steps comprising:

(a) forming an elongated core member having a tool engaging end and a grip end;

(b) molding on said core member adjacent said tool engaging end a synthetic resin sleeve having a peripheral collar extending about its end disposed towards said grip end, said sleeve being securely interlocked with said core; and (c) molding on said core member a grip member of relatively resilient material extending about said core member from said grip end and having an end portion overlying and interlocked with said collar on said sleeve, said gripping member also being securely interlocked with said core member.

15. The method for making handles in accordance with claim 14 wherein said core member is formed from synthetic resin.

16. The method for making handles in accordance with claim 14 wherein said core member is formed with a channel therein extending from said grip end and over a portion of the length of said core member and said step of molding of said grip member produces a portion disposed within said channel to interlock said core and grip members.

17. The method for making handles in accordance with claim 16 wherein said core member is formed with a cross section providing a major axis and a minor axis.

18. The method for making handles in accordance with claim 17 wherein said core member is formed with a slot therein extending across said core member in said major axis providing said channel.

19. The method for making handles in accordance with claim 18 wherein said sleeve is molded of a relatively rigid synthetic resin and has an intermediate body portion and a peripheral groove between said body portion and said collar, said collar being of lesser cross sectional dimensions than the dimensions of said body portion.

20. The method for making handles in accordance with claim 19 wherein said collar is of lesser dimensions than the dimensions of said body portion, and said overlying portion of grip member has a peripheral surface contour which blends into the peripheral surface contour of said body portion of said sleeve.

* * * * *